US005187526A

United States Patent [19]

Zaretsky

[11] Patent Number: 5,187,526

[45] Date of Patent: Feb. 16, 1993

[54] METHOD AND APPARATUS OF FORMING A TONER IMAGE ON A RECEIVING SHEET USING AN INTERMEDIATE IMAGE MEMBER

[75] Inventor: Mark C. Zaretsky, Rochester, N.Y.

[73] Assignee: Eastman Kodak Company, Rochester, N.Y.

[21] Appl. No.: 764,018

[22] Filed: Sep. 23, 1991

[51] Int. Cl.[5] ..... G03G 15/16A

[52] U.S. Cl. ..... 355/273; 355/326

[58] Field of Search ..... 355/272, 273, 277, 326, 355/271, 274

[56] References Cited

U.S. PATENT DOCUMENTS 3,781,105 12/1973 Meagher .
3,862,848 1/1975 Marley .
4,190,348 2/1980 Friday .
4,712,906 12/1987 Bothner et al. .
4,931,839 6/1990 Tompkins et al. .
5,053,827 10/1991 Tompkins et al. ..... 355/271
5,084,735 1/1992 Rimai et al. ..... 355/271

FOREIGN PATENT DOCUMENTS 0323226 7/1989 European Pat. Off. .

*Primary Examiner*—A. T. Grimley
*Assistant Examiner*—Nestor R. Ramirez
*Attorney, Agent, or Firm*—Leonard W. Treash

[57] ABSTRACT

One or more toner images are transferred to an intermediate image member and then to a receiving sheet. The intermediate image member is made relatively conductive, for example, it has a resistivity less than $10^9$ ohm-cm facilitating transfer to the intermediate. To provide adequate allowance for variability for the impedance of receiving sheets a transfer backing roller forms a nip with the intermediate image member which transfer backing roller has a relatively low conductivity. For example, the transfer backing roller has a resistance of $10^{10}$ ohm-cm or greater.

6 Claims, 2 Drawing Sheets

METHOD AND APPARATUS OF FORMING A TONER IMAGE ON A RECEIVING SHEET USING AN INTERMEDIATE IMAGE MEMBER

BACKGROUND OF THE INVENTION

1. Field of the Invention

This invention relates to the formation of toner images on a receiving sheet using an intermediate image member. It is particularly usable in color electrophotographic systems in which the intermediate image member is used to accumulate a series of single color images in registration to form a multicolor image and the multicolor image is transferred in a single step to the receiving sheet.

2. Description Relative to the Prior Art

Although other methods of transfer of toner images are known, by far the most common commercially used method of transferring a toner image from one surface to another is electrostatic. An electric field is applied to a toner image of a size and direction causing the toner particles to transfer. Traditionally, the most common method of creating an electric field for transfer is to spray corona on a reverse side of a sheet or web engaged in the transfer.

However, for a number of reasons the use of one or more backing rollers or similar members to create the electric field has a number of advantages. For example, in color systems, a receiving sheet can be attached to a drum and the drum rotated to bring the sheet through transfer relationship with a primary image member. An electric field between the drum and the image member superposes a series of single color images on the sheet creating a multicolor image. See, for example, U.S. Pat. No. 4,712,906, Bothner et al, issued Dec. 15, 1987 which is representative of a large number of references in commercial apparatus using this approach.

U.S. Pat. No. 3,781,105 granted to Meagher Dec. 25, 1973 suggests a backing roller for transferring single color images to a receiving sheet. In this instance the reference suggests that the backing roller have an outside layer or layers of a low intermediate conductivity and that a constant current source be used for establishing an electric field. The intermediate conductivity is established by using material having a resistivity of $10^9$ to $10^{11}$ ohm-cm. This material is conductive enough to permit the establishment of an electric field but provides a relatively high impedance which causes the field to be less variable in response to variations in the receiving sheet. With such more resistant materials, receiving sheets can vary between paper and transparency stock and also as to thickness and ambient relative humidity without an unacceptable variation in the field that would cause insufficient transfer in some instances or electrical breakdown in others.

Backing rollers having a resistivity in the neighborhood of $10^{10}$ ohm-cm are commonly made by doping a high resistance polyurethane material with tiny conductive particles such as carbon, iron or other antistatic materials sufficiently to provide the conductivity needed.

Although such backing rollers having a high resistivity are considered preferred in such systems, they do generate problems. If the field is provided between two members that roll in contact with each other, the field is constantly being established through that rolling contact. The substantial resistance of the backing roller increases the time constant in establishing the field thereby either increasing the necessary size of the nip for transfer or reducing the speed of the system.

A number of references show the use of intermediates in both single color image formation and multicolor image formation. For example, FIG. 8 of the above mentioned U.S. Pat. No. 4,712,906 shows a series of single color images being formed on a primary image member. The single color images are transferred in registration to an intermediate roller to create a multicolor image on the surface of the roller. A multicolor image is then transferred in a single step to a receiving sheet at a position remote from the primary image member. This system is particularly advantageous in forming multicolor toner images, because the receiving sheet does not have to be attached to a roller for recirculation but can be fed along a substantially straight path. It can also be used with single color toner image formation for a number of other reasons including facilitating duplex and preventing contact between a primary image member and a receiving sheet which may contaminate the image member with paper fibers and the like.

U.S. Pat. No. 4,931,839 granted to Tompkins et al on Jun. 5, 1990 shows use of an intermediate web of relatively high intermediate conductivity which superposes single color toner images by transfer from a primary image member. The images are transferred to a receiving sheet which is backed by a conductive roller. Substantial impedance does not appear to be provided at this transfer to allow for variations in receiving sheet impedance.

SUMMARY OF THE INVENTION

It is an object of the invention to provide a method and apparatus for forming a toner image on a receiving sheet using an intermediate transfer member, which can be either a drum or a web, with the advantages that are obtained from use of an intermediate, while still handling a variety of receiving sheets and operating at reasonable speed.

This and other objects are accomplished by a method and apparatus in which an electrostatic image is formed on a primary image member. Toner is applied to the electrostatic image to create a toner image corresponding to the electrostatic image. The toner image is carried by the primary image member into transfer relation with an intermediate image member having a resistivity less than $10^9$ ohm-cm while applying an electric field between the image members sufficient to transfer the toner image to the intermediate image member. The toner image is then brought into transfer relation with a receiving sheet while the receiving sheet is backed by a transfer backing member having a resistivity of $10^{10}$ ohm-cm or greater in the presence of an electric field between the intermediate image member and the transfer backing member urging transfer of the toner image to the receiving sheet.

Using the invention, the relatively high conductivity of the intermediate image member facilitates fairly rapid transfer of toner images from the primary image member to the intermediate image member using a fairly narrow nip. A high resistance intermediate image member is not necessary at this transfer because no receiving sheet is present. At the second transfer in which the receiving sheet is present, impedance is provided by the transfer backing member rather than the intermediate image member and the nip is somewhat longer allowing for the slower rise time of the electric field.

This invention is particularly usable in color processes in which the color image is created on the intermediate image member by superposition of a series of single color images formed on the primary image member. Superposition of the single color toner images on the intermediate image member is facilitated by a more conductive intermediate image member. The second transfer to the receiving sheet is facilitated by the less conductive transfer backing member in that transfer.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
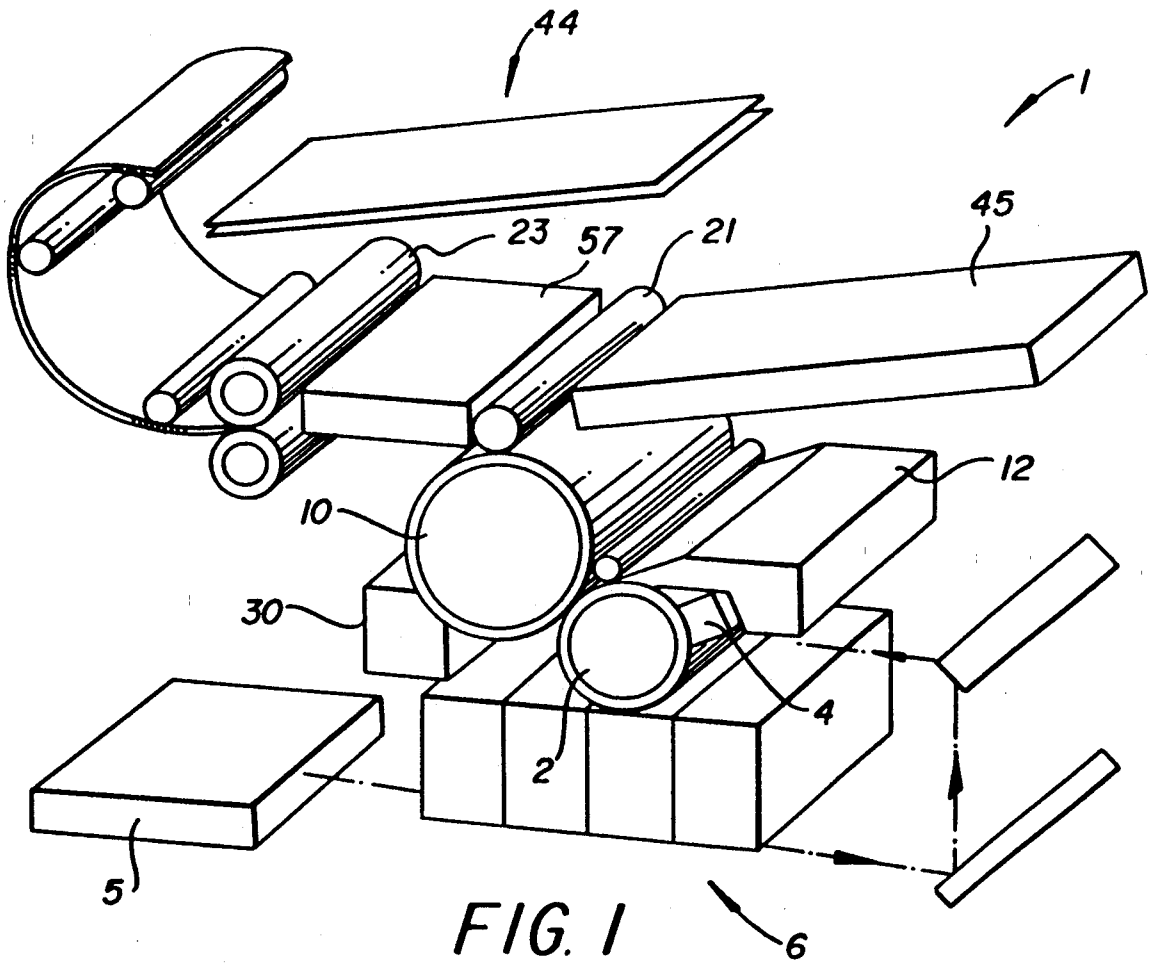
FIG. 1 is a perspective view of an image forming apparatus utilizing the invention with only basic components shown for clarity of illustration.
Figure 2:
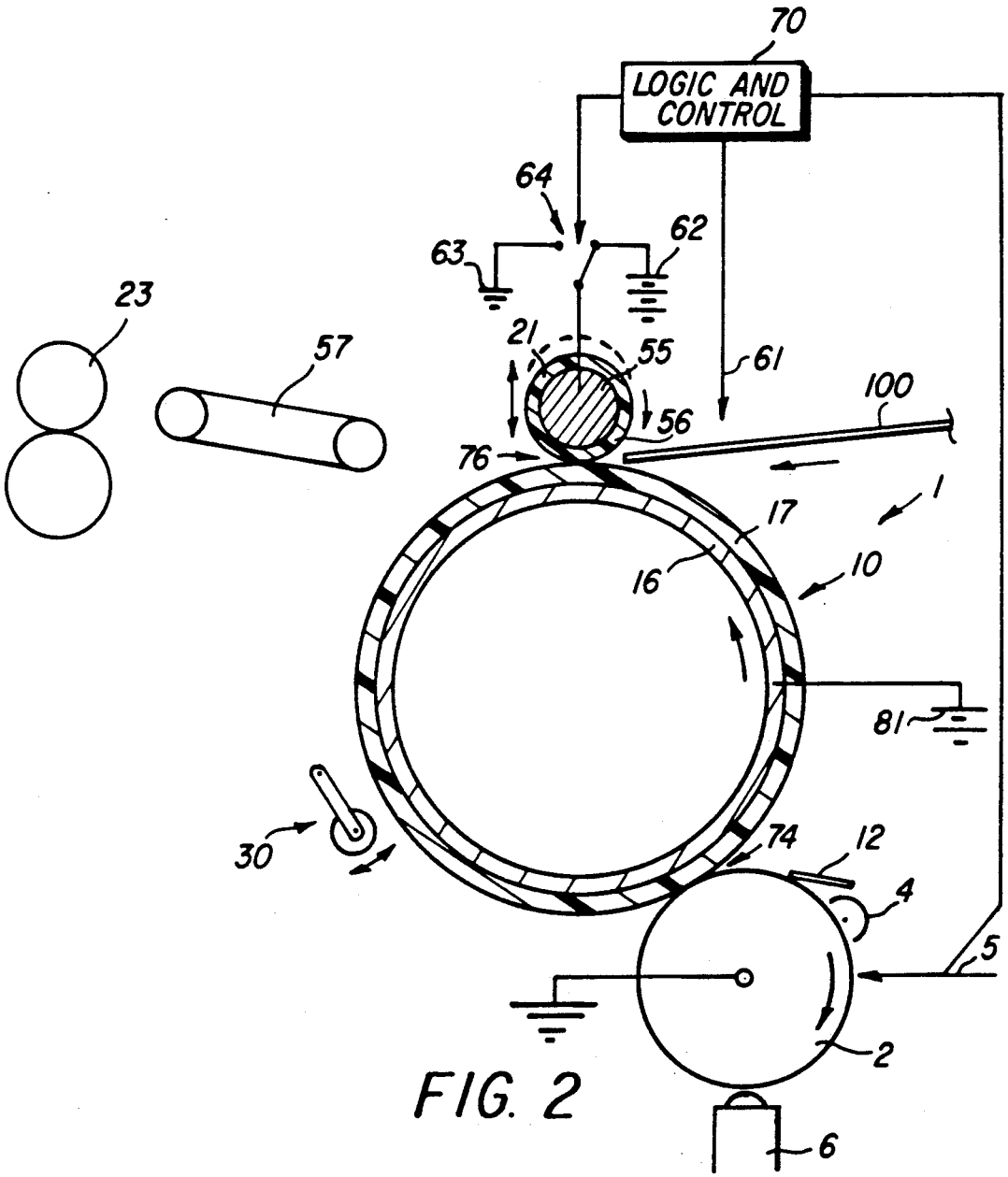
FIG. 2 is a front view of the image forming apparatus shown in FIG. 1. with some portions shown in section and some portions shown schematically for clarity of illustration.

According to FIGS. 1 and 2, an image forming apparatus 1 includes a primary image member, for example, a photoconductive drum 2, upon which a series of different color toner images are formed. More specifically, the outside surface of drum 2 is uniformly charged by a corona charging device 4. The uniformly charged surface is imagewise exposed by suitable exposure means, for example, a laser 5 to create a series of electrostatic images. Each of the electrostatic images is toned by a different color toner by a toning station 6. Toning station 6, as best shown in FIG. 1, includes four separate toning devices each carrying a different color toner. Each device is separately indexed into toning relation with drum 2 to apply different color toner to each of the series of images carried on drum 2 to create a series of different color toner images.

The different color toner images are transferred, one after another, in registration, to the outside surface of a secondary or intermediate image member, for example, an intermediate drum 10, to form a multicolor image. As shown in FIG. 2, drum 10 includes a metallic conductive core 16 and a thin layer of polyurethane 17 which has been doped with sufficient antistatic particles to have a relatively low intermediate resistance, for example, a resistance of approximately $10^8$ ohm-cm. With such a relatively conductive intermediate image member 10, transfer of the single color toner images to the surface of drum 10 can be accomplished with a relatively narrow nip 74 and a relatively modest potential of, for example, 600 volts applied by potential source 81.

The multicolor image formed on the surface of drum 10 is transferred in a single step to a receiving sheet 100 which is fed into a nip 76 between drum 10 and a transfer backing member, for example a transfer backing roller 21, which will be described in more detail.

The receiving sheet 100 is fed from a receiving sheet supply 45 (FIG. 1) into nip 76 (FIG. 2) where it receives the multicolor image. The receiving sheet exits the nip 76 and is transported by transport mechanism 57 to a fuser 23 where the multicolor image is fixed to it. The receiving sheet with the fixed multicolor image is then transported to an output hopper 44.

The primary image member, photoconductive drum 2, is continuously cleaned by a blade cleaner 12. The intermediate image member, intermediate transfer drum 10, is intermittently cleaned by transfer drum cleaner 30 which is articulated into cleaning relation with drum 10 after the multicolor image is transferred to the receiving sheet.

Various portions of the image forming apparatus 1 can be supplied in a cartridge. For example, photoconductive drum 2, charging station 4, cleaning station 12 and transfer drum cleaning device 30 can be fully contained in a cartridge having appropriate openings for interface with laser 5, development station 6 and transfer drum 10. This allows replacement of the drum and disposal of cleaned toner by the operator at suitable periodic intervals.

Along the path between receiving sheet supply 45 and nip 76 are appropriate sensors, for example, a sensor 61 which determines when a leading (or trailing) edge of a receiving sheet reaches a predetermined point in the path. Sensor 61 feeds this information back to a logic and control system 70 which controls the image forming apparatus.

As the transfer sheet leaves nip 76, it may have a tendency to electrostatically stick to drum 10. This can be reduced by making transfer backing roller 21 smaller and somewhat harder than intermediate image member 10 thereby providing a tendency to the receiving sheet to curl in a direction away from attachment with drum 10.

Receiving sheet 100 can vary substantially. For example, it can be a thin or thick paper stock or transparency stock. Each of these types of sheets contributes a different impedance to the field associated with nip 76. Further, variations in relative humidity will vary the conductivity of a paper receiving sheet which also causes it to have a varying effect on the impedance of the field. To reduce problems caused by this effect, transfer backing roller 21 is composed of a conductive core 55 and a thin layer 56 of a relative high intermediate resistance material. For example layer 56 can be composed of polyurethane which is been doped with sufficient conductive particles to give it a resistance of $1.5\times10^{10}$ ohm-cm. The resistance of layer 56 is chosen to be sufficiently conductive to be used to establish an electric field for transferring the toner image from drum 10 to receiving sheet 100. At the same time, it is sufficiently nonconductive to provide a substantial impedance in the field which reduces the variation in the field caused by variations in receiving sheet 100.

Since drum 10 is moving at the same speed for the second transfer as it does for the first transfer the nip 76 will have to be somewhat wider than nip 74. This is because the greater total impedance in the field establishing transfer at nip 76 (than the impedance at nip 74) increases the time constant associated with establishing the field. Greater nip length is required to establish the full transfer force while the sheet is still in the nip. This greater nip length is provided by a relatively high force urging transfer backing roller 21 against intermediate drum 10.

Both layers 56 and 17 can be made of polyurethane which has been doped with sufficient antistatic material to provide the described effect. As described above, we have found that better overall results are achieved in a two transfer system, as shown in FIG. 2, if layer 17 has a conductivity substantially greater than that of layer 56. Accordingly, at 21° C. and 50% relative humidity, it is preferable that layer 17 have a resistance less than $10^9$ ohm-cm, preferably about $10^8$ ohm-cm and layer 56 should have a resistance greater than $10^{10}$ ohm-cm, preferably $1.5\times10^{10}$ ohm-cm. The more conductive layer 17 provides good transfer for superposing four single color toner images on the surface of layer 17 with a narrower nip 74. This permits higher speeds at nip 74 and also facilitates the use of higher pressures. Nip 76 is somewhat wider, provided by the increased loading force on roller 21, mentioned above, to allow for the greater impedance in nip 76. The receiving sheet 100 also provides a very small amount of extra compliance and therefore width to nip 76.

Apparatus 1 is not only capable of forming multicolor images, but it may be used to form single color images as well. In such a mode, a continuous series of images are formed on drum 2, transferred to drum 10 and then transferred to a continuous series of receiving sheets fed into nip 76. Although roller 21 is conventionally articulated away from transfer drum 10 between the transfer of multicolor images to permit the formation of the multicolor image on drum 10, it is left in contact with drum 10 when transferring single color images. To prevent the pickup of toner from drum 10 between transfers in this mode, roller 21 is biased with a potential source that can be adjusted. More specifically, when transferring multicolor or single color images the field in nip 76 is created by biasing roller 21 with a relatively high bias from constant current potential source 62, shown connected to roller 21 in FIG. 2. Potential source 62 can be of a constant voltage type. However, it is preferably of a constant current type well known for use in this type of application, and supplying a current of, for example, four microamps. At all times that transfer backing roller 21 is in contact with drum 10 without the presence of a receiving sheet in nip 76, logic and control 70 activates a switch 64 to switch roller 21 to ground potential. Since drum 10 is already biased to an intermediate potential, for example, of 600 volts by potential source 81, this has the effect of reversing the field in nip 76 and inhibits transfer of toner to backing roller 21 from drum 10.

Actuation or control of switch 64 can be accomplished by logic and control 70 according to several aspects of machine timing. For example, logic and control 70 can control switch 64 according to the formation of images on drum 2 by exposure means 5 to ground roller 21 as an image leaves nip 76 and apply a bias to roller 21 as a new image enters nip 76. Additionally, logic and control 70 can control switch 64 in response to sensors, such as sensor 61 which may indicate the presence or lack of a receiving sheet approaching nip 76. Thus, if a jam or misfeed results in no receiving sheet approaching nip 76 even though an image is approaching nip 76, that condition is signaled by sensor 61 to logic and control 70 and the bias on transfer roller 21 is maintained at ground until the condition is corrected and a receiving sheet successfully approaches nip 76. This feature is important in medium and high speed apparatus because roller 21 may not be articulatable away from roller 10 in response to a jam quickly enough to prevent an image being transferred directly to roller 21. However, switch 64 can be actuated or controlled quickly, thereby preventing toner from adhering directly to the surface of roller 21.

Although reversing the electric field between the transfer backing roller 21 and intermediate drum 10 prevents the transfer of most toner to transfer backing roller 21, transfer of virtually all of the toner to backing roller 21 can be prevented if the exterior of roller 21 includes a thin layer of an offset preventing material. For example, a 5 micron coating of a hard urethane resin sold under the trade name Permuthane by Permuthane, Inc., a division of ICI Inc. did not inhibit a transfer of toner from drum 10 to the receiving sheet, but did, when the field was reversed, virtually eliminate the transfer of toner to roller 21 when no receiving sheet was present.

The invention has been described in detail with particular reference to a presently preferred embodiment, but it will be understood that variations and modifications can be effected within the spirit and scope of the invention.

What is claimed is:

1. A method of forming a toner image on a receiving sheet, said method comprising:

forming an electrostatic image on a primary image member, applying toner to the electrostatic image to create a toner image corresponding to said electrostatic image, bringing the toner image carried by the primary image member into transfer relation with an intermediate image member having a resistivity of less than $10^9$ ohm-cm while applying an electric field between said primary image member and said intermediate image member sufficient to transfer said toner image to said intermediate image member, and bringing said transferred toner image into transfer relation with a receiving sheet while said receiving sheet is backed by a transfer backing member having a resistivity of $10^{10}$ ohm-cm or greater in the presence of an electric field between said intermediate image member and said backing member urging transfer of said toner image to said receiving sheet.

2. A method according to claim 1 wherein said forming step includes forming a series of electrostatic images on a primary image member and said applying step includes applying different colored toners to said electrostatic images to form a series of different color toner images which toner images are transferred in registration to said intermediate image member to form a multicolor image which is transferred to said receiving sheet.

3. A method according to claim 1 wherein the resistivity of the intermediate image member is approximately $10^8$ ohm-cm and the resistivity of the transfer backing member is approximately $1.5\times10^{10}$ ohm-cm.

4. Image forming apparatus comprising:

means for forming an electrostatic image on a primary image member, means for applying toner to the electrostatic image to create a toner image corresponding to said electrostatic image, an intermediate image member having a resistivity of less than $10^9$ ohm-cm, means for applying an electric field urging the toner image from the primary image member to the intermediate image member to transfer said toner image to the intermediate image member, a transfer backing roller having a resistivity of $10^{10}$ ohm-cm or greater and positioned to form a transfer nip with said intermediate image member, means for feeding a receiving sheet into said nip, and, means for creating an electric field between said transfer backing roller and said intermediate image member to transfer said toner image from said intermediate image member to said receiving sheet.

5. Image forming apparatus comprising:

a primary image member consisting of a photoconductive drum having a photoconductive insulating layer defining an outside surface, means for uniformly charging said outside surface, means for imagewise exposing said outside surface to form a series of electrostatic images thereon, means for applying toners of different colors to said series of electrostatic images to form a series of different color toner images, an intermediate image member consisting of an intermediate drum having a resistivity of less than $10^9$ ohm-cm and positioned in transfer relation with said photoconductive drum, means for applying an electric field between said photoconductive drum and said intermediate drum to transfer each of said series of toner images to the surface of said intermediate drum in registration to form a multicolor toner image on said intermediate drum, a transfer backing roller positioned to form a transfer nip with said intermediate drum, said transfer backing roller having a resistivity of at least $10^{10}$ ohm-cm, means for feeding a receiving sheet into the transfer nip between said transfer backing roller and said intermediate drum, and means for applying an electric field between said transfer backing roller and said intermediate drum urging the transfer of the multicolor image from the intermediate image member to the receiving sheet.

6. The apparatus according to claim 5 wherein said transfer backing roller has an outside surface of an offset preventing material.

* * * * *